US007284721B2

(12) United States Patent
Strauss et al.

(10) Patent No.: US 7,284,721 B2
(45) Date of Patent: Oct. 23, 2007

(54) IMPACTOR ANVIL

(75) Inventors: Graham Strauss, Cheltenham (AU); Peter Hale, Merrylands (AU)

(73) Assignee: Crushing & Mining Equipment Pty Ltd. (AU)

( * ) Notice: Subject to any disclaimer, the term of this patent is extended or adjusted under 35 U.S.C. 154(b) by 0 days.

(21) Appl. No.: 10/494,145

(22) PCT Filed: Oct. 30, 2002

(86) PCT No.: PCT/AU02/01475

§ 371 (c)(1),
(2), (4) Date: Aug. 23, 2004

(87) PCT Pub. No.: WO03/037516

PCT Pub. Date: May 8, 2003

(65) Prior Publication Data

US 2005/0001082 A1 Jan. 6, 2005

(30) Foreign Application Priority Data

Oct. 30, 2001 (AU) ..... PR8583

(51) Int. Cl.
*B02C 19/00* (2006.01)

(52) U.S. Cl. ..... 241/275

(58) Field of Classification Search ..... 241/274, 241/275

See application file for complete search history.

(56) References Cited

U.S. PATENT DOCUMENTS 1,532,742 A * 4/1925 Hadsel ..... 241/275
1,547,385 A * 7/1925 Hadsel ..... 241/275
3,110,449 A * 11/1963 Bridgewater ..... 241/286
4,651,936 A * 3/1987 Fleming ..... 241/222
4,699,326 A 10/1987 Warren
5,533,685 A * 7/1996 Heck ..... 241/275
5,806,774 A * 9/1998 Vis ..... 241/275
5,921,484 A * 7/1999 Smith et al. ..... 241/275
6,171,713 B1 * 1/2001 Smith et al. ..... 428/614
6,227,472 B1 5/2001 Ryan et al.

FOREIGN PATENT DOCUMENTS

EP 0166672 A2 1/1986
EP 0261913 A2 3/1988
EP 0677328 B1 9/1999

* cited by examiner

*Primary Examiner*—Faye Francis
(74) *Attorney, Agent, or Firm*—Sheridan Ross P.C.

(57) ABSTRACT

Prism-shaped anvil blocks (10) are arranged about the inner circumferential wall (12) of a rotating shaft impactor chamber (14). Each anvil block has a planar face 16 oriented to receive material thereonto for breakage. The breakage face (16) of each anvil block (10) is not obscured (that is, shadowed) by an adjacent anvil block (10A), so that the trajectory of travel of material ejected from a rotor (18) is uninterrupted by the shape or position of the adjacent anvil block (10A), to reduce the unevenness of abrasive wear. Each anvil block (10) is retained at the inner circumferential wall (12) by a concealed post (24) which is located on a lateral, inwardly projecting peripheral ledge 26 of the chamber (14). Each post (24) is received in a respective mating cavity (28) formed in each anvil block (10). The ingress of any material into the small gap between the mating cavity (28) and the post (24) is substantially prevented by its concealment, thus avoiding jamming of the anvil.

26 Claims, 6 Drawing Sheets

22
28
10
16
Z
22A
D 30
28

30
10
16
22A

28
D

IMPACTOR ANVIL

FIELD OF THE INVENTION

The present invention relates to the components of an impactor apparatus for breaking feed materials passed thereinto. In one form the invention relates to an anvil for use in a rotating shaft impactor and will primarily be described with reference to this context. It should be remembered, however, that the components of the invention have broader use in feed breakage applications in all manner of crushing or breaking equipment.

BACKGROUND ART

Impactors for breakage of materials are known in the art. Such apparatus includes a rotating impeller device arranged to rotate about an axis. Feed materials such as rock, gravel, mineral ores and the like are passed into the rotating impeller device via an inlet. The materials are ejected from the impeller device to impact against a ring of anvils positioned on the inner surface of the surrounding walls of the impactor, and are thereby attritioned. Due to the nature of the feed materials and the duty required of the apparatus, the anvils are normally made of a high strength and abrasion resistant alloy metal or other materials and this is usually an expensive item. In use the anvils are subjected to significant and uneven wear over a period of time.

SUMMARY OF THE INVENTION

In a first aspect the present invention provides a plurality of single-anvil elements arranged in a rotating shaft impactor chamber, each element with a breakage face oriented to receive material thereonto for breakage, the material being directed onto the breakage face by a rotatable impelling device located in the impactor chamber, wherein the anvil elements are arranged discretely and spaced apart in the chamber such that a breakage face of an element is not obscured by an adjacent element, so that the travel of material ejected from the impelling device and onto one breakage face is uninterrupted by the adjacent anvil element.

Such an arrangement of anvil elements can reduce the unevenness of abrasive wear experienced by the anvils. In known impactor apparatus, material for breakage normally strikes the anvil and is broken or partially broken down in size, and then slides across the breakage face in the same direction as the direction of rotation of the rotatable impelling device before being discharged from the impactor. In known anvil arrangements, the anvils are typically adjacent to one another with some 'shadowing' or overlap. If a portion of the anvil is shadowed by an adjacent anvil, the shadowed portion does not experience material impact or sliding thereupon. In the present invention the whole breakage face of the anvil is exposed to receive material thereonto, and the wear is more even across the face. Rather than producing uneven or differential wearing of the anvil for example wear which, when the anvil is viewed in plan, is angularly disposed to the original orientation of the breakage face, the wear on the anvil of the invention has been found to be more consistently in a plane parallel to the original orientation of the breakage face (when viewed in plan). This prolongs the effective usage time of the anvil before replacement of the entire anvil is required.

Preferably the travel of the ejected material is tangential to an effective discharge periphery of the rotatable impelling device. When the term "tangential" is used it is to be understood that in the present invention at least some of the ejected material can have a small radial velocity component (radial being along a path extending radially from a centre of the rotatable impelling device and out of the effective discharge periphery), but that the velocity of the ejected material is largely tangential. Typically-the percentage ratio of radial to tangential velocity components is around 5% or less.

Preferably the anvil elements are located around an inner periphery of the rotating shaft impactor chamber. Preferably the anvil elements are made of a wear resistant material, such as a strong impact resistant alloy or a hard material such as a metal carbide layer or a sprayed hard metal or ceramic, for example.

Preferably the breakage face of each anvil element is substantially planar. Most preferably the breakage face is oriented in use orthogonally to the travel of the ejected material so that the whole breakage face of the anvil is exposed to receive material thereonto, and the wear is more even across the face. When the term "orthogonally" is used it is to be understood in the present invention that, as already mentioned, since at least some of the ejected material can have a small radial velocity component, there can be some degree of variation in the orthogonality of the orientation of the breakage face with regard to the direction of travel of the ejected material, and also because of variations in shape and orientation of the breakage face.

Preferably each anvil element is generally in the form of a prism. Preferably each anvil element is bevelled on at least one corner, the bevelled corner located in use to abut an inner peripheral wall of the rotating shaft impactor chamber.

In a second aspect the present invention provides an anvil element for positioning at an inner periphery of a rotating shaft impactor chamber in which material for breakage is directed by a rotatable impelling device located in the impactor chamber to travel toward and to impact the element, a positioning means being arranged to position the anvil at the chamber and comprising one or more inter-fitting projections and recesses, one of the projections or recesses formed on the anvil and the other at the chamber, the positioning means being concealed from the material so that ingress of material between the projections and recesses is substantially prevented. When the term "substantially prevented" is used it is to be understood that in the present invention at least some fine particulate material can become lodged into the positioning means of the present invention, although the tendency for this material to enter and remain in the positioning means is very much reduced compared with the known apparatus because of the substantial concealment of the positioning means from the impactor chamber.

In known arrangements for fastening anvil elements into an impactor chamber, one side of each anvil element typically has a protruding T-shaped tongue extending over the height of the anvil element, the tongue being insertable into a respective channel which is positioned at an inner periphery of the impactor chamber. Typically the channel is open at one end to the impactor chamber. Although the tongue and channel are usually located at a side of the anvil element away from the material breakage face, fine particulate material (particularly dust etc) from feed or attritioned material can flow over the anvil edges and become lodged and packed into the gap between the tongue and channel. This can effectively jam an anvil element into the channel, making removal a difficult and time consuming exercise when replacement of the anvil (when worn or broken, etc) is required.

A substantially concealed positioning means has the effect of rendering the removal of the anvil elements a relatively easy task compared with the known apparatus. Less operator effort or strain due to pulling is required.

Preferably the positioning means includes a projection on either the element or chamber for receipt in a corresponding mating cavity on either the chamber or element respectively. Preferably the projection is a post extending from an inwardly projecting peripheral ledge of the chamber and the anvil element includes the mating cavity substantially corresponding in dimension to the projection. Preferably the mating cavity is cylindrical and circular in cross-section.

Preferably the anvil element of the second aspect has the features of the anvil element as defined in the first aspect.

Preferably the bevelled corner and the positioning means generally fix the anvil element in a non-rotating position when located in the rotating shaft impactor chamber.

Preferably a further corner of the element that is remote of both a portion including the mating cavity and a portion at which the materials impact, is bevelled.

In an alternative arrangement the positioning means can includes a projection on the element for receipt in a corresponding mating cavity on the chamber. In such an arrangement the projection and the cavity can also be concealed from the material in the impactor so that ingress of material into the cavity is substantially prevented. In such an arrangement, preferably an anvil element is provided including a main body and the projection is a tongue extending from the main body, and the mating cavity is a channel which is located at or near an inner peripheral wall of the chamber, the channel substantially corresponding in dimension to the tongue, the anvil element further including a cover plate which extends outwardly from the main body and conceals the tongue when the tongue is located in the cavity.

Preferably the tongue is arranged for sliding receipt into the channel. Preferably the tongue is elongate, T-shaped in cross-section and a stem of the T-shape is arranged to project from the main body for at least a portion of its vertical height. Preferably the channel is elongate and arranged at the inner peripheral wall for at least a portion of its vertical height, with an in use upper end of the channel being open to receive the tongue therethrough. Most preferably when the tongue is located in the channel in use the upper end of the channel is concealed by the cover plate. In this alternative arrangement, preferably the channel is defined in a bracket mountable at or near the inner peripheral wall of the chamber.

In a third aspect the present invention provides an anvil element for positioning at an inner periphery of a rotating shaft impactor chamber in which material for breakage is directed by a rotatable impelling device located in the impactor chamber to travel toward and to impact the element at a breakage face, wherein the anvil element is bevelled on at least one corner, the bevelled corner being spaced apart from and angularly disposed to the breakage face and located in use to abut an inner peripheral wall of the chamber, the angle of the bevel relative to the breakage face arranged to predetermine the breakage face orientation.

In a fourth aspect the present invention provides a plurality of anvil elements arranged in a rotating shaft impactor chamber, each element with a breakage face oriented to receive material thereonto for breakage, the material being directed onto the breakage face by a rotatable impelling device located in the impactor chamber, wherein the anvil elements are arranged closely adjacent to one another so as to provide a substantially continuous breakage face in the chamber and being oriented relative to one another such that a breakage face of an element is not obscured by an adjacent element, so that the travel of material ejected from the impelling device and onto one breakage face is uninterrupted by the adjacent anvil element.

In a fifth aspect the present invention provides a support for a plurality of anvil elements located at an inner periphery of a rotating shaft impactor chamber in which material for breakage is directed by a rotatable impelling device located in the impactor chamber to travel toward and to impact the elements, the anvil elements positioned at the support by one or more interfitting projections and recesses., wherein the support comprises a lateral, inwardly projecting ledge and one of the inter-fitting projection(s) and recess(es) formed on one of opposing surfaces of the ledge, so that when an anvil element is positioned at the support, the ingress of material between the projection(s) and recess(es) is substantially prevented.

Preferably the projections are posts spaced apart from one another so that, when the anvil elements are each located on the support, a predetermined distance exists between adjacent anvil elements.

Preferably the anvil elements of the fifth aspect are otherwise as defined in any one of the first, second, third or fourth aspects.

In a sixth aspect the present invention provides a rotating shaft impactor including anvil element(s) as defined in any one of the first, second, third or fourth aspects.

In a seventh aspect the present invention provides a rotating shaft impactor including a support as defined in the fifth aspect.

BRIEF DESCRIPTION OF THE DRAWINGS

Notwithstanding any other forms which may fall within the scope of the present invention, preferred forms of the invention will now be described, by way of example only, with reference to the accompanying drawings in which.

MODES FOR CARRYING OUT THE INVENTION

Figure 1:
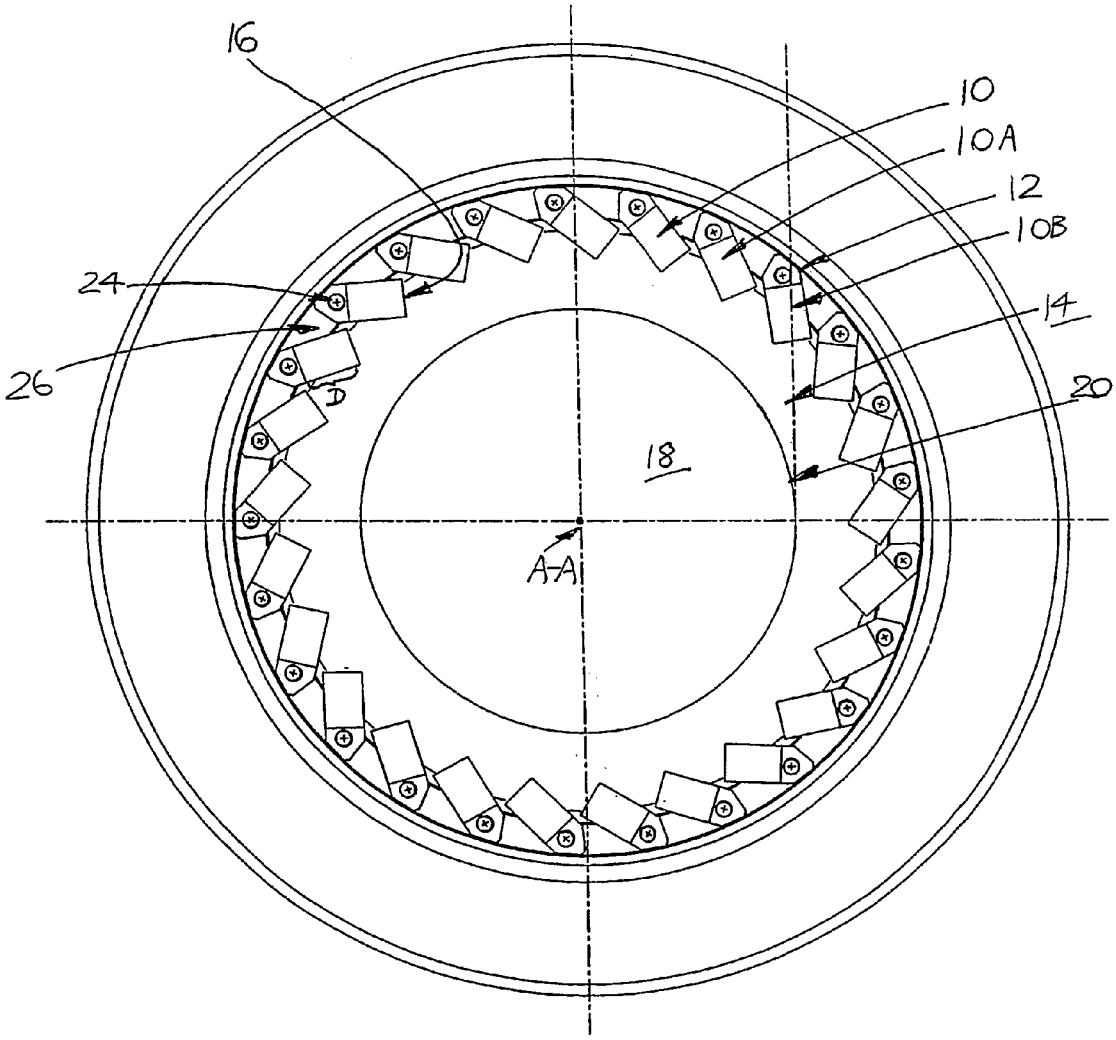
FIG. 1 shows a plan view of one embodiment of a plurality of anvil elements arranged in a rotating shaft impactor chamber in accordance with the invention.
Figure 2:
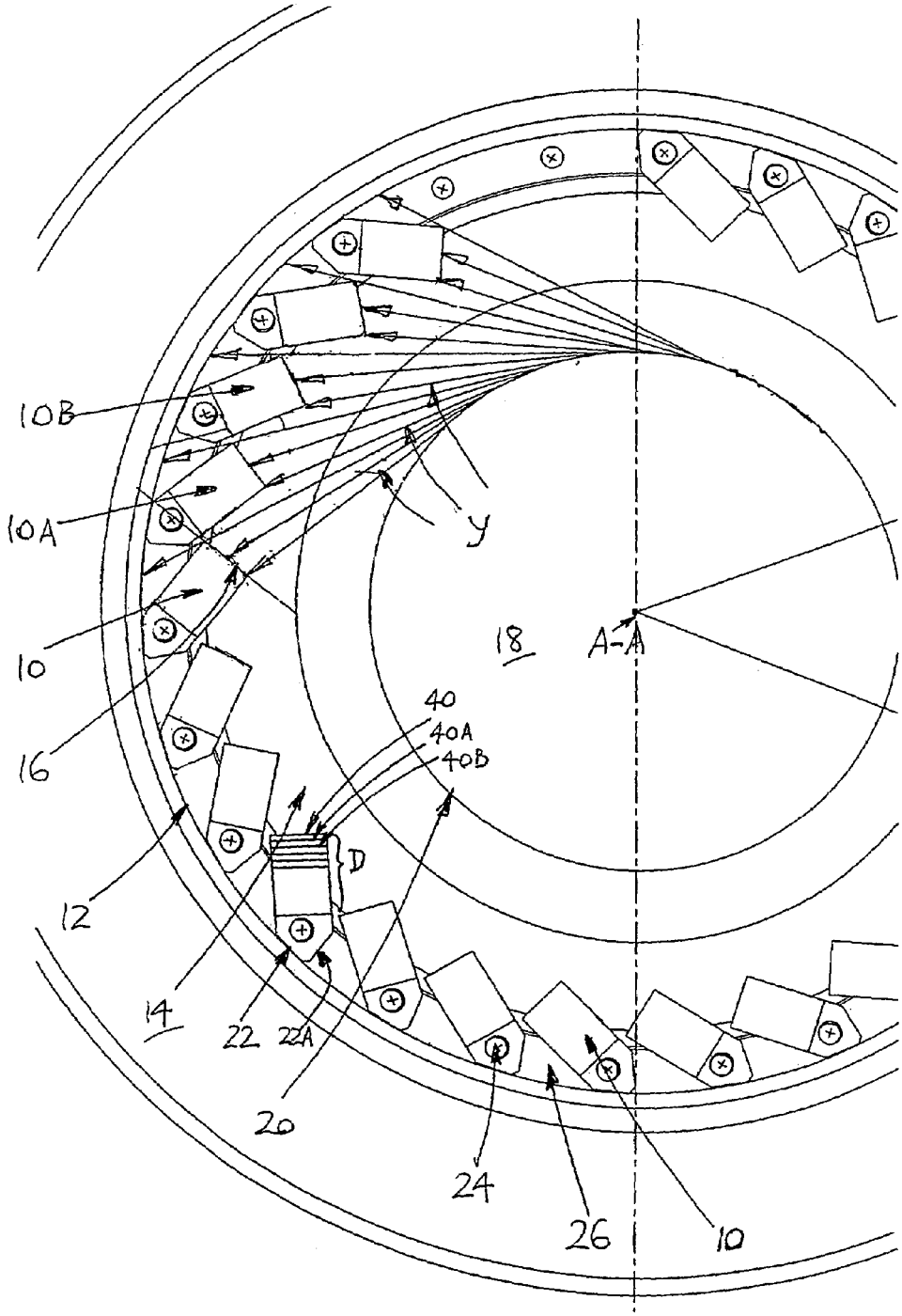
FIG. 2 shows a more detailed view of the embodiment of FIG. 1.

Referring to the drawings, in FIGS. 1 and 2 a plurality of anvil elements each in the form of a prism-shaped anvil block 10 of rectangular cross-section are arranged evenly about the inner circumferential wall 12 of a rotating shaft impactor chamber 14. Each anvil block has a planar breakage face 16 oriented to receive material thereonto for breakage. The material is directed onto the breakage face 16 by a rotatable impelling device in the form of a rotor 18 located in the centre of the impactor chamber 14. The rotor 18 is arranged to rotate about a vertical axis A-A (shown drawn into the page).

In the preferred embodiment shown, feed materials for breakage are gravity-fed into the rotor 18. Any relatively coarse feed material which is desired to be reduced to relatively finer size product material can be fed to the rotor 18 including rock, gravel, mineral ores, metalliferous slags, glass and the like, or organic materials such as coal, grain, woodchips etc. The relatively coarse materials are ejected radially out of the rotor 18 under a centrifugal force. The materials impact the wall-mounted anvil blocks 10 (or impact other rocks located adjacent the anvil block for autogenous breakage) and are broken apart or attritioned to become a relatively finer size product material.

In further embodiments of the invention the axis of rotation of the impelling rotor and the impactor chamber (which are normally maintained in the same relative position to one another) can be located on any angle from the vertical A-A up to and including a horizontal axis. In any embodiment it is possible that the feed materials can be passed into the rotor by, for example, a pumping arrangement; the feed materials may therefore be suspended in a fluid, such as in a slurry, for example. Such a feeding arrangement may be more important in those embodiments of the invention where gravity-feeding of the apparatus alone is not feasible.

The anvil blocks 10 are arranged around the chamber inner circumferential wall 12 so that the breakage face 16 of each anvil block 10 is not obscured (that is, shadowed) by an adjacent anvil block 10A, so that the trajectory of travel of material ejected from the rotor 18 and onto a breakage face 16 is uninterrupted by the shape or position of the adjacent anvil block 10A. The travel of the ejected material is tangential to an effective discharge periphery 20 of the rotor 18, with a trajectory as shown by the lines Y drawn in FIG. 2.

Figure 8:
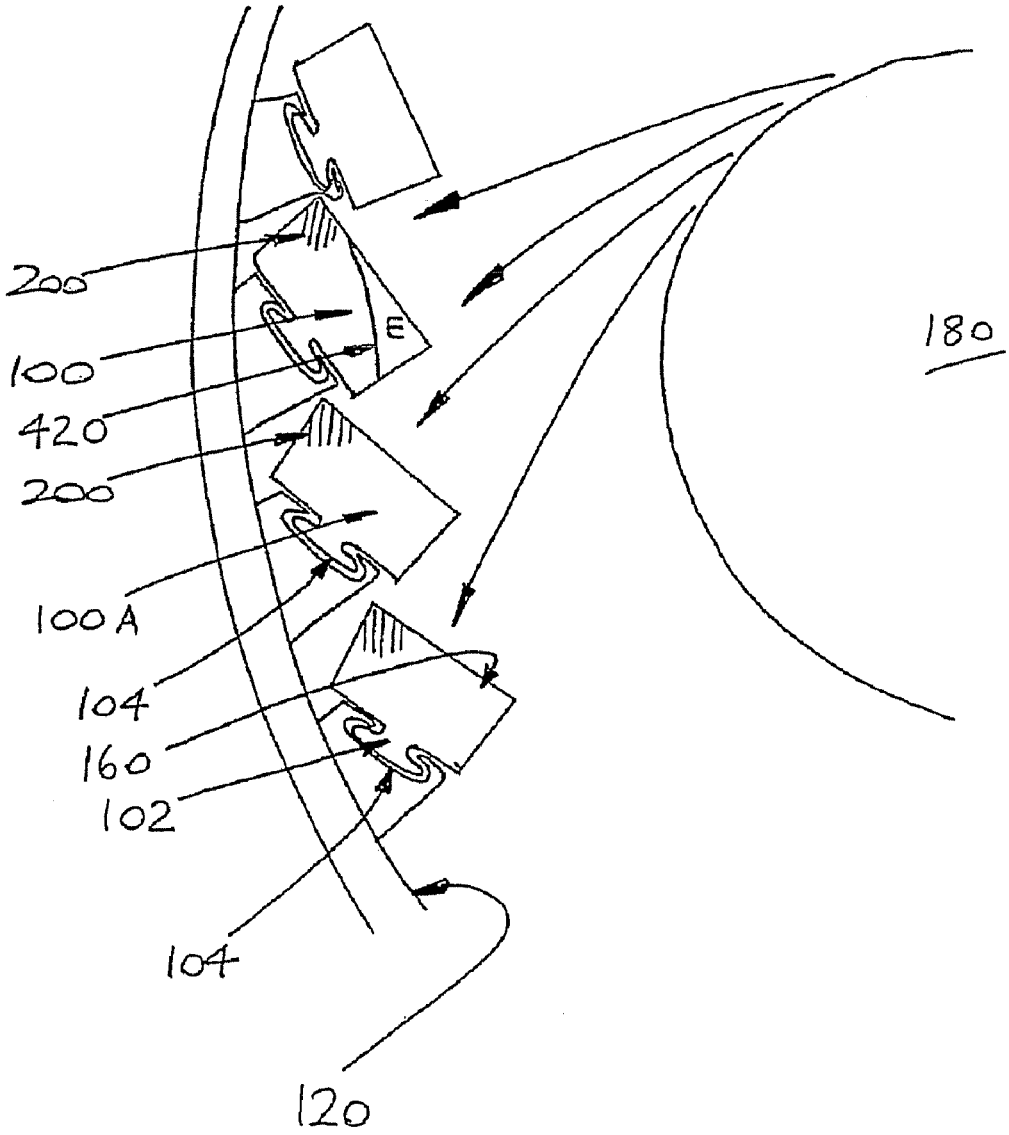
FIG. 8 PRIOR ART
FIG. 8 shows a plan view of an embodiment of a prior art arrangement of anvil elements in a rotating shaft impactor chamber.

In FIG. 8 an embodiment of the prior art apparatus is shown to illustrate a presently available arrangement. The anvil blocks 100, 100A etc are fastened into an impactor chamber by a protruding T-shaped tongue 102 extending over the height of each anvil block 100, 100A etc on one side. Each tongue 102 is shown inserted into a respective channel 104 which is positioned at an inner circumferential wall 120 of the impactor chamber 110. The anvil blocks 100, 100A etc are arranged around the chamber inner circumferential wall 120 so that the breakage face 160 of each anvil block 100 is partially obscured by an adjacent anvil block 10A, so that the trajectory of travel of material ejected from the rotor 180 and onto a breakage face 160 can be interrupted by the shape and position of the adjacent anvil block 10A. That portion adjacent the breakage face 160 of the anvil block 100 that does not receive any impact from material is shown as a shaded region 200.

In the preferred embodiment of the present invention as shown in FIGS. 1 to 7, the anvil block 10 is in the form of a solid piece of a wear resistant material, such as a strong and wear resistant alloy, a metal carbide or a strong ceramic, for example. In some embodiments just the breakage face 16 of the anvil block 10 can be formed from a layer of material resistant to wear and abrasion, such as a metal carbide, for example, tungsten carbide, or indeed a sprayed carbide or a hard ceramic. The breakage face may also be treated to be hardened. In such an instance a special hardening process can be carried out on the anvil block before it is placed into service. In such examples, the base portion (the portion used for positioning the anvil block and not exposed to wear by impacted material) can typically be made of a less expensive material, such as mild steel, although other typical examples can include aluminium, brass, high density polyethylene, or other hard plastics.

In the embodiment shown, the breakage face 16 of each anvil block 10 is substantially planar, and the breakage face 16 is oriented orthogonally to the trajectory of travel of the material ejected from the rotor so that the whole breakage face 16 is exposed to receive material thereonto. In this way the wear on the anvil block 10 is more evenly spread across the breakage face 16 when viewed in plan. When the word "orthogonally" is used it should be interpreted as including an angle of trajectory that can be up to 7 degrees away from an exactly orthogonal trajectory (of ninety degrees), the exact angle offset from orthogonal being at least somewhat dependant on the position from which the material is discharged from the rotor 18.

Such an arrangement of anvil blocks 10 can reduce the unevenness of abrasive wear. In the present invention the whole breakage face 16 of the anvil block 10 is exposed to receive material thereonto. When viewed in a plan cross-sectional view, rather than wearing unevenly into the anvil block 10 to produce worn a breakage face which is angularly disposed to the original orientation of the breakage face 16 (as found using prior art apparatus and as shown by wear line 420 drawn on one anvil block 100 in FIG. 8, with triangular cross-section eroded portion E shown in plan view), the anvil block 10 of the invention is eroded approximately in a plane parallel to the original orientation of the breakage face. This is shown in FIG. 2, where the depth D of the anvil block 10 retreats at an approximately even rate of erosion shown by erosion lines 40, 40A, 40B and so on, which are consecutively reached as a function of the time of use of the apparatus. This in fact prolongs the effective usage time of the anvil block 10 before replacement of the anvil block 10 is required.

In still further embodiments it is envisaged that the breakage face of an anvil block can also be non-planar, and, for example, when viewed in either plan cross-section or side elevation, may be convex, concave or otherwise curved in such a manner deemed appropriate to maximise anvil block wear life while still providing no obscuration of the breakage face of the adjacent anvil block. For example, the breakage face can have a greater thickness of hard outer layer material at one side to discourage preferential wearing of the type seen in the use of the prior art anvil blocks (and as shown by eroded portion E in FIG. 8). In such embodiments the orthogonal relationship between the trajectory of travel of the ejected material and the breakage face will be subject to some variation as mentioned earlier herein.

In the embodiment of the invention shown in the figures, the end of the anvil block 10 furthest from the breakage face 16 has both corners 22, 22A bevelled. When placed in position, one of the bevelled corners 22 of the anvil block 10 abuts the inner circumferential wall 12 of the rotating shaft impactor chamber 14. The anvil block 10 is then retained at the inner circumferential wall 12 by a concealed positioning means in the form of a post 24 which is located on a lateral, inwardly projecting peripheral ledge 26 of the chamber 14. In use the post 24 is received in a respective mating cavity 28 formed in the base of an anvil block 10. The mating cavity 28 substantially corresponds in dimension to the post 24. As shown in the drawings the mating cavity 28 and the post 24 are both cylindrical and circular in cross-section, although in other embodiments the post and cavity can be of another shape, for example the post and cavity can be square or hexagonal in cross-section. In still further embodiments the post can even be conical in shape to be received in a mating conically-shaped recess in the anvil block. Other shapes are also within the scope of the invention. In still further embodiments there can also be more than one post for insertion into an anvil block, if required.

Because the post 24 is concealed from the flow of materials in the impactor chamber 14 in use, the ingress of any material into the small gap between the mating cavity 28 and the post 24 is substantially prevented. This represents an improvement over the prior art arrangement for fitting anvils into the wall of an impactor chamber, where the channels for retaining the anvil are open at least at one end to the impactor chamber so that fine or attritioned particulate material (e.g. grit, dust etc) can become lodged into the channel. This can effectively jam an anvil into the channel, making removal a difficult and time consuming exercise when replacement of the entire (worn) anvil is required.

A substantially concealed positioning means has the effect of rendering the removal of the anvil elements a relatively easy task compared with the known apparatus. Less operator effort or strain due to pulling is required.

Were it not for the bevelled edge 22 the end of the anvil block 10 which abuts the inner circumferential wall 12, the anvil block 10 may rotate about the post 24. Depending on the angle of the bevelled edge made during casting the anvil block 10, the orientation of the anvil block 10 can be adjusted depending on the chosen diameter of the inner circumferential wall 12 and the diameter of the rotor 18. A range of sizes of anvil blocks with different angles of bevelled edge 22, depths D in combination with various rotor 18 diameters is envisaged. The use of wedges of shims is also possible to adjust the anvil block orientation when fitted into position on the ledge 26.

Figure 3:
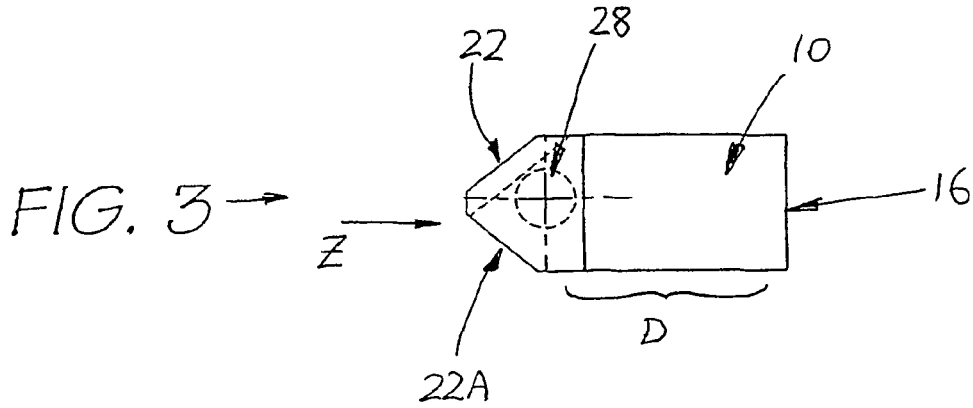
FIG. 3 shows a plan view of one embodiment of an anvil element in accordance with the invention.
Figure 4:
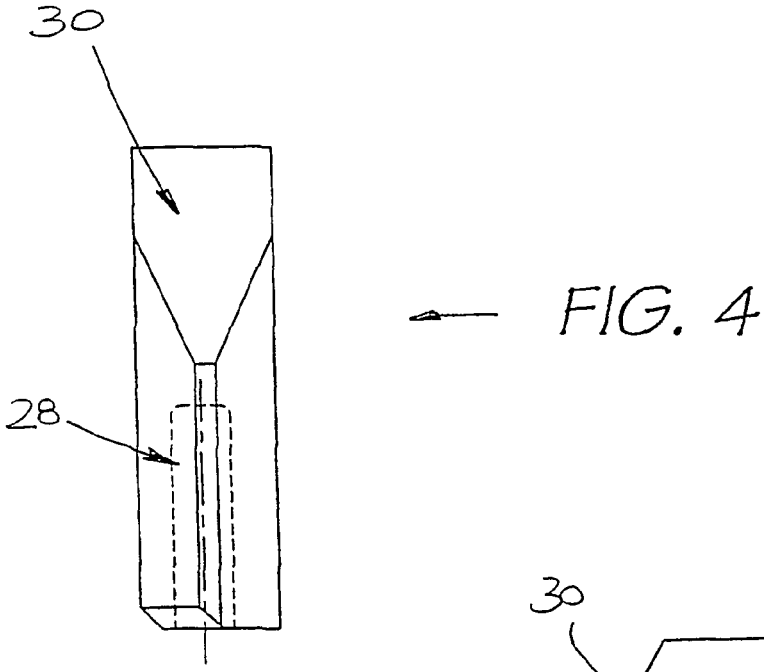
FIG. 4 shows an end view of the embodiment of FIG. 3 when viewed in the direction of arrow Z.
Figure 5:
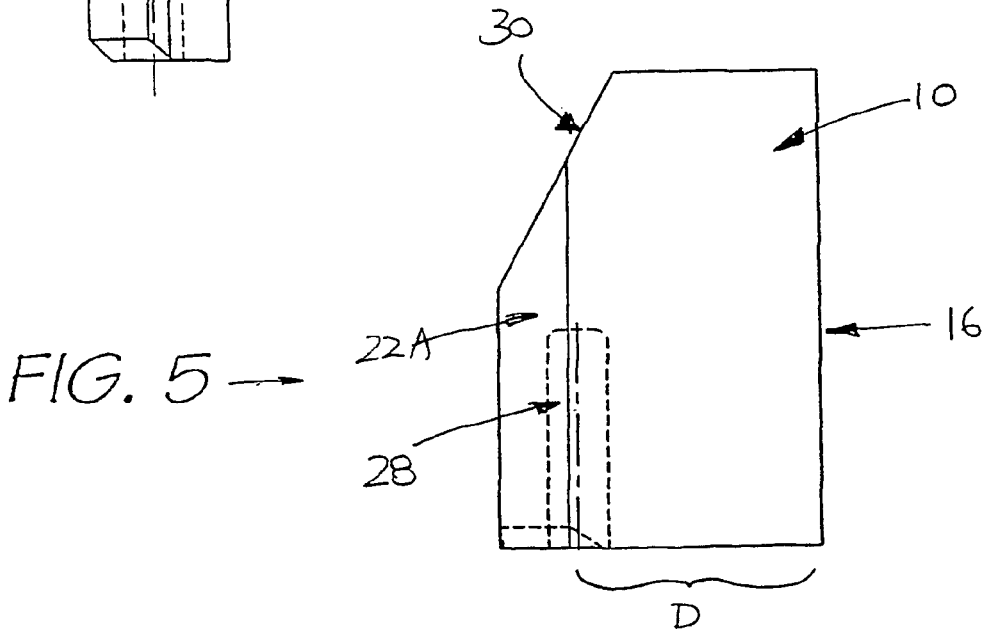
FIG. 5 shows a side elevation of the embodiment of FIG. 3.

Also shown in FIGS. 3 to 5 is the upper rear corner 30 of the anvil block 10 that is remote of the breakage face 16. This corner 30 optionally has a bevelled edge shape to reduce the weight of the anvil block 10 overall so that each anvil block is able to be more readily removed by a maintenance operator.

In further preferred embodiments, the anvil block 10 can be retained at the inner circumferential wall 12 by a concealed positioning means in the form of a post which protrudes from the base of the anvil block and is received in a respective mating cavity located in the lateral, inwardly projecting peripheral ledge 26 of the chamber, where again the mating cavity substantially corresponds in dimension to the post. Once again any shape of cavity and post is within the scope of the invention.

Figure 6:
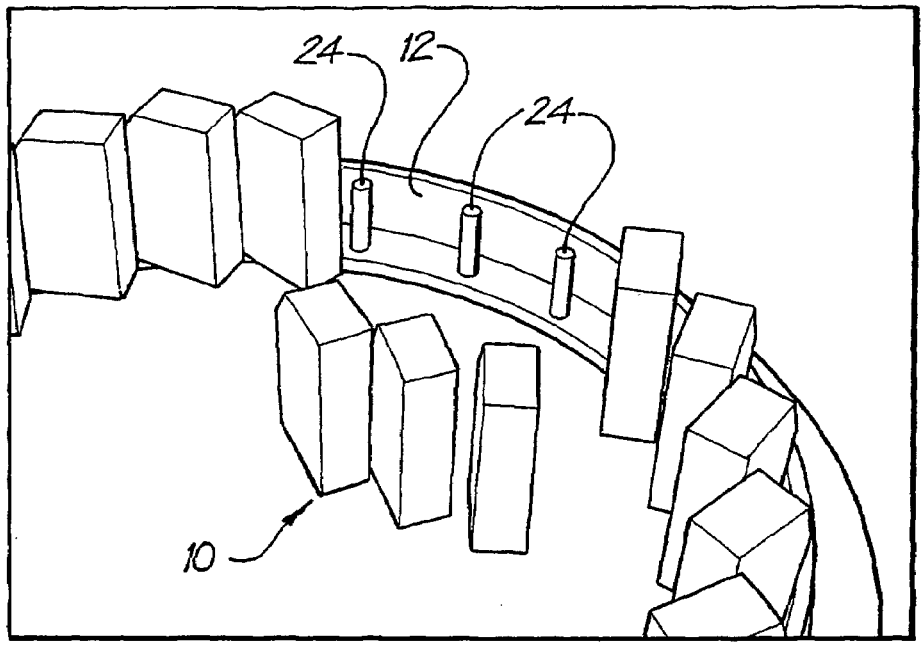
FIG. 6 shows a photograph of one embodiment of a support for a plurality of anvil elements in accordance with the invention where some of the anvil elements have been removed to more clearly show the support.
Figure 7:
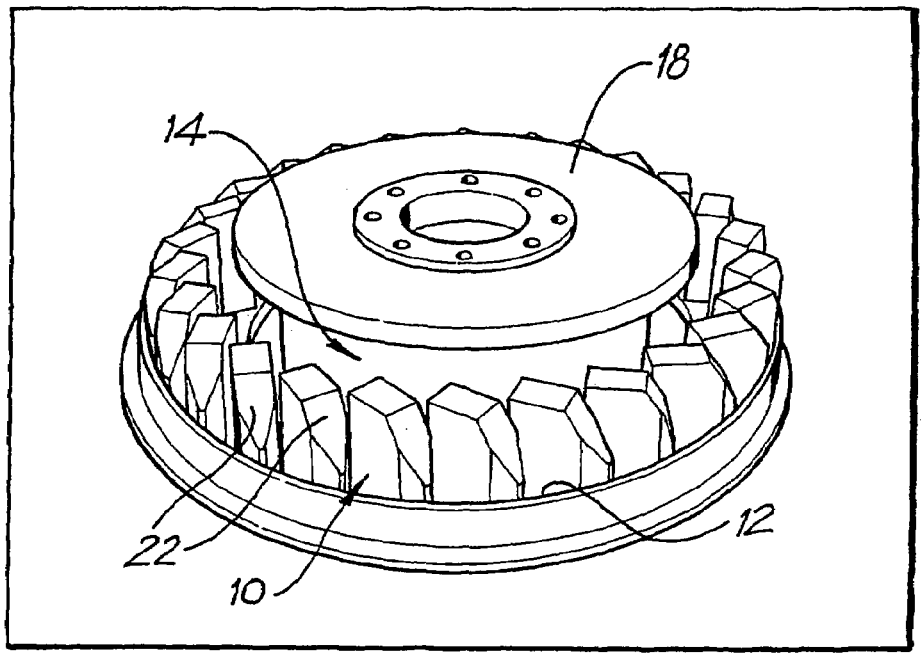
FIG. 7 shows another photograph of the embodiment shown in FIG. 6 where all of the anvil elements are placed on the support and a rotatable impelling device is shown where it would be positioned when the anvil elements, the support and the rotatable impelling device are installed in the impactor chamber.

As shown in FIGS. 1, 2 and 6 the inwardly-projecting lateral peripheral ledge 26 of the chamber 14 provides a support for a plurality of spaced apart anvil blocks 10, 10A, 10B etc by having a plurality of projections in the form of posts 24 of circular cross-section located thereon, each post 24 for receipt in a respective mating cavity 28 in a base of an anvil block 10. In an alternative embodiment the ledge can have a plurality of cavities located therein, each cavity for receiving a respective mating projection of an anvil block. In either embodiment, the posts are spaced apart from one another so that, when the anvil blocks are each located on the ledge 26, a predetermined distance exists between adjacent anvil blocks. It is noted that there is no requirement for the anvil blocks to be evenly spaced, and any arrangement of spacing between either the posts located on the ledge, or, in the alternative embodiment, between the cavities located in the ledge is within the scope of the invention.

In the present invention the position of the anvil blocks is generally determined by the position of the hole in (or the projection from) the anvil block itself, the angle of the bevelled edge 22 corner of the anvil block and the width of the peripheral ledge 26. Depending on the application, changes can be made to any of these variables in order to locate the anvil blocks at a desired angle, or in order to select a desired number of anvil blocks for placement in an impactor chamber.

In the present invention the anvil blocks 10 are removable for servicing, replacement etc. An operator can reach into the chamber 14 and, by lifting withdrawal of the individual anvil blocks 10, disengage the post 24 from the respective mating cavity 28. In normal operation the anvil blocks 10 are seated in position under the influence of gravity.

Figure 9:
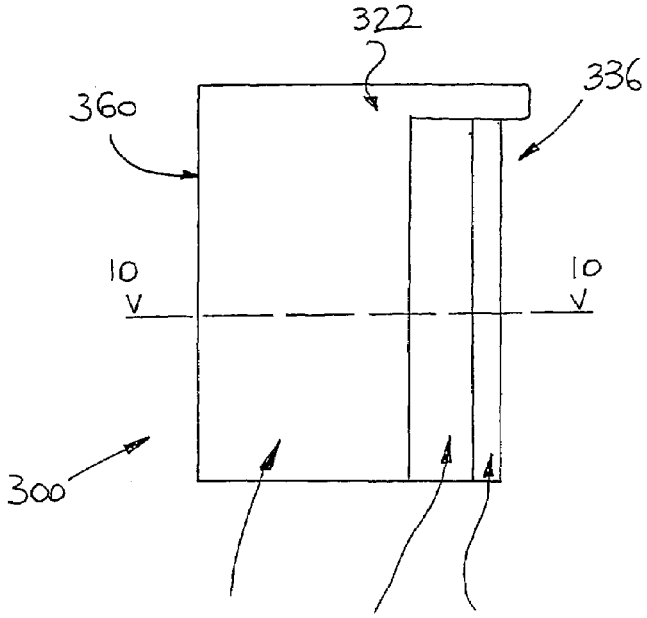
FIG. 9 shows a side elevational view of one embodiment of an anvil element for use in a rotating shaft impactor chamber in accordance with the invention.
Figure 10:
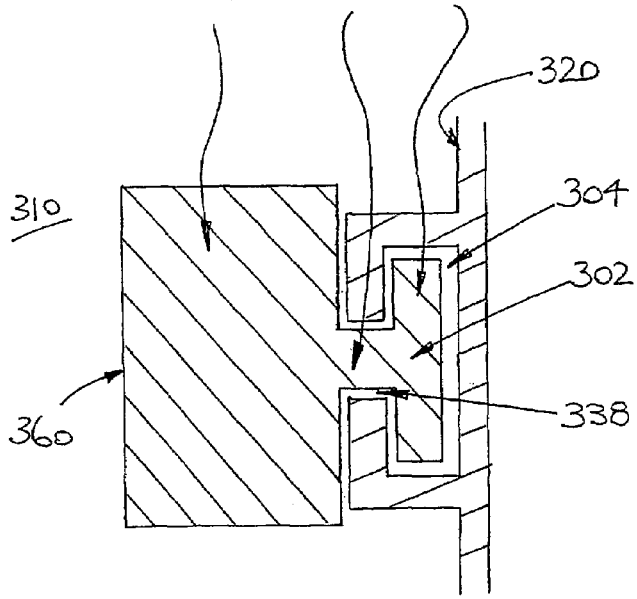
FIG. 10 shows a plan cross-sectional view of one embodiment of the anvil element of FIG. 9 when arranged in a rotating shaft impactor chamber in accordance with the invention when the anvil and impactor chamber are sectioned at line 10-10.
Figure 10A:
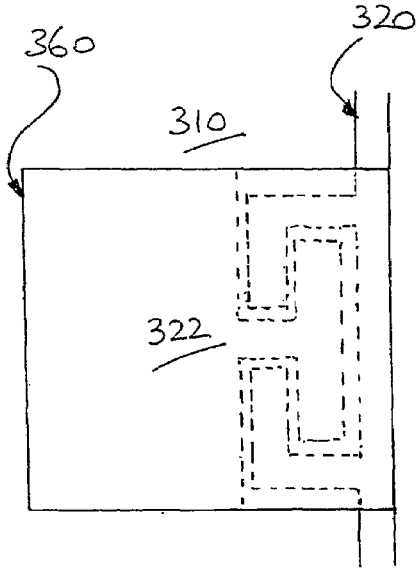
FIG. 10A shows a plan view of one embodiment of the anvil element of FIG. 9 when arranged in a rotating shaft impactor chamber in accordance with the invention, the broken lines indicating hidden detail of the positioning means.

In other embodiments within the scope of the invention, the anvil blocks can also be positioned at or near any part of the inner circumferential wall of the rotating shaft impactor chamber by other positioning means which can be concealed from the ingress of attritioned material. The positioning means illustrated in FIGS. 1 to 7 are only one way of attaching the anvil blocks to the impactor chamber. For example, FIGS. 9, 10 and 10A show an anvil block 300 that is somewhat similar to the type shown in the prior art in FIG. 8, the anvil block being fastenable to the interior of the impactor chamber by a protruding T-shaped tongue 302. The tongue 302 is located on the side 336 of the anvil block 300 that is remote from the breakage face 360. The tongue 302 comprises a plate 330 and a web 332 which joins the plate 330 to the main body portion 334 of the anvil block 300, and the tongue 302 extends outwardly over almost all of the vertical height of the anvil block 300 on one side 336. In FIGS. 10 and 10A the tongue 302 is shown when slidably inserted into a respective mating cavity in the form of a channel 304 which is positioned (or formed) at the inner circumferential wall 320 of the impactor chamber 310. The tongue 302 shown in FIGS. 10 and 10A substantially corresponds in size to the channel 304 so that the anvil is tightly held in the channel 304.

To position the anvil block 300 into the impactor chamber 310, the tongue 302 is inserted into the in use upper end of the channel 304 which is open to receive the tongue 302 therethrough, the web 332 fitted into a channel opening in the form of a slot 338. As shown in FIGS. 10 and 10A the width and depth of the channel 304 and of the slot 338 are closely related to the dimensions of the web 332 and plate 330. In this embodiment, when fitted with the tongue 302, the channel 304 is not open to the ingress of fine particulate material (particularly dust etc) from feed or attritioned material because of the presence of an upper plate 322 located on the anvil block 300. The upper plate 322 projects from an upper end of the main body portion 334 and adjoins the uppermost end of the tongue 302 and thus conceals the channel 304 to substantially prevent the ingress of particulates thereinto. If the lowermost end of the channel 304 is open to the impactor chamber 310, any material that does find its way into the space between the channel 304 and the tongue 302 will not tend to remain in that space due to gravity. In some cases the lowermost end of the channel 304 can be closed to prevent ingress of any material from the chamber 310.

In the preferred embodiment shown in FIGS. 10 and 10A the channel 304 is elongate and is arranged directly at the inner circumferential wall 320 of the impactor chamber 310 for at least a portion of the vertical height of the chamber 310. In other embodiments the, mating cavity can be in the form of a bracket mountable at or near the inner circumferential wall 320 of the chamber 310. For example, such brackets can be mounted onto an inwardly-projecting peripheral ledge located in the chamber of the type described previously, or onto another removably insertable assembly located in the chamber. In still further embodiments the mating cavity can be in the form of a channel located on or as part of the anvil blocks themselves, on the side of the anvil blocks remote from the breakage face, and the tongue can project from the inner circumferential wall of the impactor chamber, or be connected to an inwardly projecting peripheral ledge via other brackets or flanges or other joining arrangements as required.

The use of a system of posts and holes as shown in the embodiment in FIGS. 1 to 7 to hold anvil blocks in position allows the flexibility of constructing an impactor which has an overall larger number of smaller (or thinner) anvil blocks compared with those known in the art. Thus, the individual anvil blocks in the invention can generally be of smaller mass than those in the art, and consequently can be relatively easier to install and remove by a single operator, which can further reduce operator effort or strain.

In still further embodiments of the invention the inwardly-projecting lateral peripheral ledge 26 which supports the spaced anvil blocks can be retrofitted into other types of impactor apparatus which do not necessarily utilise anvil blocks. For example, some impactors are known as "rock on rock" impactors are known in the art, where a material is discharged radially outwardly from a rotating impelling device and into contact with a circumferential channel or groove filled with the same material to cause breakage. In such apparatus the channel is somewhat similar in shape to a car tyre in shape and located about the rotating impelling device forming an impactor chamber. In these impactors, autogenous breakage of materials by impact with other similar materials is practised, rather than material impacting onto anvils. It is envisaged that in this type impactor it is possible to insert an inwardly-projecting ledge which can have projections thereon for retaining anvil blocks with holes therein (or a ledge having holes for receiving projections located on anvil blocks, or any other variations as described herein), and to thus convert the impactor to being an anvil-type impactor, depending on the breakage application.

The performance and maintenance requirements of impactors are affected by the cost of parts and how frequently they have to be changed. A reduced frequency of servicing and maintenance intervals combined with safer and easier changing of machine parts and a lower consumption of expensive, wear resistant materials can lead to lower materials breakage or processing costs overall.

The materials of construction of the anvil blocks and the support ledge and posts can be any suitable materials which wear appropriately and that can be shaped, formed and fitted in the manners so described, such as the appropriate metal, metal alloys, ceramics or plastics etc, referred to already. The support ledge and posts do not need to be especially hardened or be made of very strong materials and can typically be formed of mild steel or from lighter weight metals such as aluminium or hard plastics and the like.

It is to be understood that, if any prior art information is referred to herein, such reference does not constitute an admission that the information forms a part of the common general knowledge in the art, in Australia or any other country.

Whilst the invention has been described with reference to preferred embodiments it should be appreciated that the invention can be embodied in many other forms.

The invention claimed is:

1. A rotating shaft impactor assembly comprising:

(a) an impactor chamber;

(b) a rotatable impelling device located in the impactor chamber; and (c) a plurality of single-anvil elements arranged adjacent one another at an inner peripheral wall of said chamber, each element with a breakage face oriented to receive material thereonto for breakage, the material being directed onto the breakage face in use by ejection from the rotatable impelling device, the anvil elements being arranged discretely and spaced apart in the chamber such that the breakage face of an element is not obscured by an adjacent element so that the travel of material onto the breakage face of that element is uninterrupted by the adjacent anvil element;

wherein the breakage face is provided on a main body of each anvil element and wherein a vertically-oriented bevelled corner is located at a spaced-apart end of the main body which is opposite to said breakage face, the vertically-oriented bevelled corner being arranged to abut the inner peripheral wall of the impactor chamber, and being angularly disposed relative to the breakage face such that the angle of the bevel predetermines the breakage face orientation.

2. An assembly as claimed in claim 1 wherein the anvil elements are located around the inner periphery of said chamber.

3. An assembly as claimed in claim 1 wherein the anvil elements are made of a wear resistant material.

4. An assembly as claimed in claim 1 wherein the breakage face of each anvil element is substantially planar.

5. An assembly as claimed in claim 1 wherein a positioning means is arranged to position the anvil at the chamber comprising one or more inter-fitting projections and recesses, one of the projections or recesses formed on the anvil and the other at the chamber, the positioning means being concealed from the material so that ingress of material between the projections and recesses is substantially prevented.

6. An assembly as claimed in claim 5 wherein the projection is a post extending from an inwardly projecting peripheral ledge of the chamber and the anvil element includes a corresponding mating cavity substantially of the same dimension to the projection.

7. An assembly as claimed in claim 6 wherein the mating cavity is cylindrical and circular in cross-section.

8. An assembly as claimed in claim 5 wherein a bevelled corner and the positioning means generally fix the anvil element in a non-rotating position when located in the rotating shaft impactor chamber.

9. An assembly as claimed in claim 8 wherein a further corner of the element that is remote of both a portion including the mating cavity and a portion at which the materials impact, is bevelled.

10. An assembly as claimed in claim 5 wherein the anvil element includes a main body and the projection is a tongue extending from the main body, and the mating cavity is a channel which is located at or near an inner peripheral wall of the chamber, the channel substantially corresponding in dimension to the tongue, the anvil element further including a cover plate which extends outwardly from the main body and conceals the tongue when the tongue is located in the cavity.

11. An assembly as claimed in claim 10 wherein the channel is defined in a bracket mountable at or near the inner peripheral wall of the chamber.

12. An assembly as claimed in claim 10 wherein the tongue is arranged for sliding receipt into the channel.

13. An assembly as claimed in claim 12 wherein the tongue is elongate, T-shaped in cross-section and a stem of the T-shape is arranged to project from the main body for at least a portion of its vertical height.

14. An assembly as claimed in claim 13 wherein the channel is elongate and arranged at the inner peripheral wall for at least a portion of its vertical height, with an in use upper end of the channel being open to receive the tongue therethrough.

15. An assembly as claimed in claim 14 wherein when the tongue is located in the channel in use the upper end of the channel is concealed by the cover plate.

16. A rotating shaft impactor assembly comprising:

(a) an impactor chamber; and (b) an anvil element for positioning at an inner peripheral wall of said chamber in which material for breakage is directed by a rotatable impelling device located in the impactor chamber to travel toward and to impact the element;

wherein the anvil element includes a main body having a breakage face, and an end opposite said breakage face, said end having at least one vertically-oriented bevelled corner arranged to abut the inner peripheral wall, the vertically-oriented bevelled corner being spaced apart from and angularly disposed relative to the breakage face such that the angle of the bevel predetermines the breakage face orientation.

17. An assembly as claimed in claim 16, comprising a positioning means arranged to position the anvil at the chamber and comprising one or more inter-fitting projections and recesses, one of the projections or recesses formed on the anvil and the other at the chamber, the positioning means being concealed from the material so that ingress of material between the projections and recesses is substantially prevented.

18. An assembly as claimed in claim 17 in which the positioning means is arranged at a support which is located in the chamber and which comprising comprises a lateral, inwardly projecting ledge wherein one of the inter-fitting projection and recess is formed on one of opposing surfaces of the ledge.

19. A support as claimed in claim 18 wherein the projections are posts spaced apart from one another so that, when the anvil elements are each located on the support, a predetermined distance exists between adjacent anvil elements.

20. A support as claimed in claim 18 wherein the anvil elements each have a breakage face orientated to receive material thereonto for breakage, wherein the anvil elements are arranged discretely and spaced apart in the chamber such that a breakage face of an element is not obscured by an adjacent element, so that the travel of material ejected from the impelling device and onto one breakage face is uninterrupted by the adjacent anvil element.

21. A rotating shaft impactor assembly comprising:

(a) an impactor chamber; and (b) an anvil element for positioning at an inner peripheral wall of said chamber in which material for breakage is directed by a rotatable impelling device located in the chamber to travel toward and to impact the element;

wherein the anvil element includes a main body and a tongue extending from the main body, the tongue arranged to interfit with a mating channel which is located at or near the inner peripheral wall of the chamber, the channel substantially corresponding in dimension to the tongue, the anvil element further including a cover plate which extends outwardly from the main body to conceal the tongue from the material when the tongue is located in the channel so that ingress of material between the tongue and channel is substantially prevented.

22. An assembly as claimed in claim 21 wherein the channel is defined in a bracket mountable at or near the inner peripheral wall of the chamber.

23. An assembly as claimed in claim 21 wherein the tongue is arranged for sliding receipt into the channel.

24. An assembly as claimed in claim 21 wherein the tongue is elongate, T-shaped in cross-section and a stem of the T-shape is arranged to project from the main body for at least a portion of its vertical height.

25. An assembly as claimed in claim 21 wherein the channel is elongate and arranged at the inner peripheral wall for at least a portion of its vertical height, with an in use upper end of the channel being open to receive the tongue therethrough.

26. An assembly as claimed in claim 25 wherein when the tongue is located in the channel in use the upper end of the channel is concealed by the cover plate.

* * * * *